US005393224A

United States Patent [19]

Allen et al.

[11] Patent Number: 5,393,224

[45] Date of Patent: Feb. 28, 1995

[54] IGNITOR ASSEMBLY FOR POWER BURNER FURNACE

[75] Inventors: Thomas E. Allen; William G. Hansen; Edward D. Hildreth, Jr., all of Clarksville, Tenn.

[73] Assignee: American Standard Inc., Piscataway, N.J.

[21] Appl. No.: 160,622

[22] Filed: Dec. 2, 1993

[51] Int. Cl.[6] ..... F23Q 3/00

[52] U.S. Cl. ..... 431/266; 431/264; 431/263; 431/328

[58] Field of Search ..... 431/264, 265, 266, 263

[56] References Cited

U.S. PATENT DOCUMENTS

| | | | |
|---|---|---|---|
| 2,964,103 | 12/1960 | Ryder | 431/264 |
| 4,098,255 | 7/1978 | Nowak et al. | 126/91 |
| 4,203,720 | 5/1980 | Chaffee et al. | 432/222 |
| 4,373,896 | 2/1983 | Zwick et al. | 431/9 |
| 4,374,637 | 2/1983 | Zwick et al. | 431/183 |
| 4,380,429 | 4/1983 | LaHaye et al. | 431/115 |
| 4,397,631 | 8/1983 | Fisher | 431/114 |
| 4,464,107 | 8/1984 | Boe | 431/264 |
| 4,629,414 | 12/1986 | Buschulte et al. | 431/46 |
| 4,643,672 | 2/1987 | Lefebvre | 431/265 |
| 4,717,332 | 1/1988 | Edens | 431/8 |
| 4,728,284 | 3/1988 | Coppin | 431/182 |
| 4,830,600 | 5/1989 | VerShaw et al. | 431/8 |
| 4,854,857 | 8/1989 | Houtman | 431/264 |
| 4,875,851 | 10/1989 | Mutchler | 431/6 |

*Primary Examiner*—Carroll B. Dority

*Attorney, Agent, or Firm*—William J. Beres; William O'Driscoll; Peter D. Ferguson

[57] ABSTRACT

An ignitor assembly for a gas combusting power furnace especially designed for both durability and ease of replacement. The ignitor assembly includes a generally elongated ignitor element and a tubular sleeve for slideably, removably mounting the ignitor element generally perpendicular to the burner plate assembly of the furnace. A retaining clip snapably holds the ignitor element within the sleeve. The transverse mounting of the ignitor relative to the burner plate places the ignitor element tip within the combustion plenum, but keeps the lead-in wires of the ignitor on the noncombustion side of the burner plate. The unique mounting arrangement of the ignitor assembly provides maintenance access to the ignitor element without the need to disassemble the burner assembly.

8 Claims, 3 Drawing Sheets

IGNITOR ASSEMBLY FOR POWER BURNER FURNACE

TECHNICAL FIELD OF THE INVENTION

This invention pertains in general to gas combusting power burner furnaces. In particular, the invention relates to a compact ignitor assembly especially adapted for easy installation and removal from the burner plate of a gas combusting power burner furnace.

BACKGROUND OF THE INVENTION

A typical gas combusting furnace system includes a furnace burner contained in a combustion chamber for generating heat, means for transferring the heat from the combustion chamber to the heated space, and means for controlling the operation of the burner. A typical furnace burner of the premix type, where fuel and air are mixed prior to introduction into the combustion chamber, includes a chamber wherein gas and air are mixed and then forced by a single speed, motor operated blower to the combustion chamber. Such furnaces are commonly referred to as "power burners" because of the forcible introduction of the gas and air mixture into the combustion chamber. In a typical premix type furnace burner, the mixture of gas and air is directed into the combustion chamber through a burner element such as a burner plate having a plurality of relatively small apertures.

Ignitors commonly used in power burner systems comprise an electrically heated hot surface element mounted adjacent the combustion side of the burner plate. The ignitor is positioned parallel to the burner screen of the power burner and perpendicular to the stream of the gas which is to be ignited. Screws are used to hold the ignitor in place, with the screws being hand torqued to specification to prevent breaking the ignitor bushing. High temperature gaskets must be used to seal the ignitor to the burner plate, since the junction temperatures between the ignitor and the burner cap can be as high as 1050 F.

Conventional ignitors are highly susceptible to breakage and failure because of the exposure to high operating temperatures. Breakage of the lead-in electrical wires due to prolonged exposure to extreme operating temperatures is a particular problem. Moreover, conventional ignitors are difficult to replace because of their alignment on the combustion side of standard burner plates. The entire burner assembly often needs to be disassembled to reach and replace the ignitor. Heretofore, these problems have been accepted as the unfortunate consequence of having to place the ignitor tip in the area where furnace fuel combustion takes place. An ignitor assembly that positioned the ignitor tip of an ignitor assembly at the desired point of combustion, but was nevertheless isolated in large measure from the extreme temperatures generated by ignition, and which, at the same time, could be easily accessed for repair or replacement, would provide decided advantages.

SUMMARY OF THE INVENTION

The problems outlined above are in large measure solved by the ignitor assembly for use in a gas combustion furnace in accordance with the present invention. The ignitor assembly hereof includes mounting apparatus to align the ignitor element parallel to the flame flow path and perpendicular to the burner plate. The transverse orientation of the ignitor assembly relative to the burner plate places the ignitor tip within the combustion plenum, but with the lead-in wires on the non-combustion side of the burner plate. The ignitor element is advantageously removable from the combustion plenum for replacement without the necessity of disassembling the burner plate from the furnace.

The ignitor assembly hereof includes a fixed retaining sleeve positioned in a mounting aperture in the face of the burner plate. An ignitor element is removably positioned within the sleeve. A clip detachably secures the ignitor element within the sleeve, and the sleeve is fixedly secured to the burner plate with a retainer clip. The ignitor element may be easily installed or removed from the retaining sleeve, without the use of tools.

It is an object of the present invention to provide a compact ignitor assembly which can be mounted perpendicular to the burner screen of the power burner and parallel to the stream of gas to be ignited.

It is a further object of the invention to provide a compact ignitor assembly which can be easily placed in position and removed without the use of tools.

Another object of the invention is to provide a compact ignitor assembly which can be removed without disassembling the burner plate of the furnace.

A still further object is to provide an ignitor assembly with components which can be utilized on different sized furnaces.

DETAILED DESCRIPTION OF THE INVENTION

Figure 1:
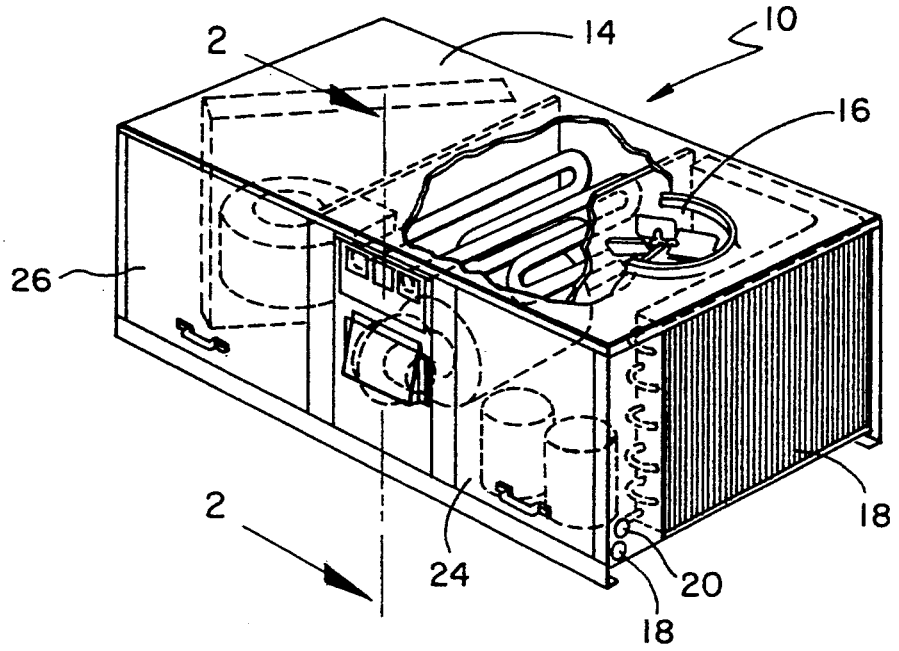
FIG. 1 is a perspective view of a heating and cooling unit having a gas combustion furnace within which the ignitor assembly of the present invention could be used.

A combination heating and cooling unit 10, having a furnace section within which an ignitor assembly 12 in accordance with the present invention could be used, is depicted in FIG. 1. Such a unit was the subject of U.S. Pat. No. 4,830,600, which is assigned to the assignee of the present invention and which is hereby incorporated by reference. The heating and cooling unit 10 broadly includes housing 14, fan 16, refrigeration unit condenser coil 18, power wires 20, control wires 22, control and compressor section 24, evaporator section access panel 26, and furnace section 28.

Figure 2:
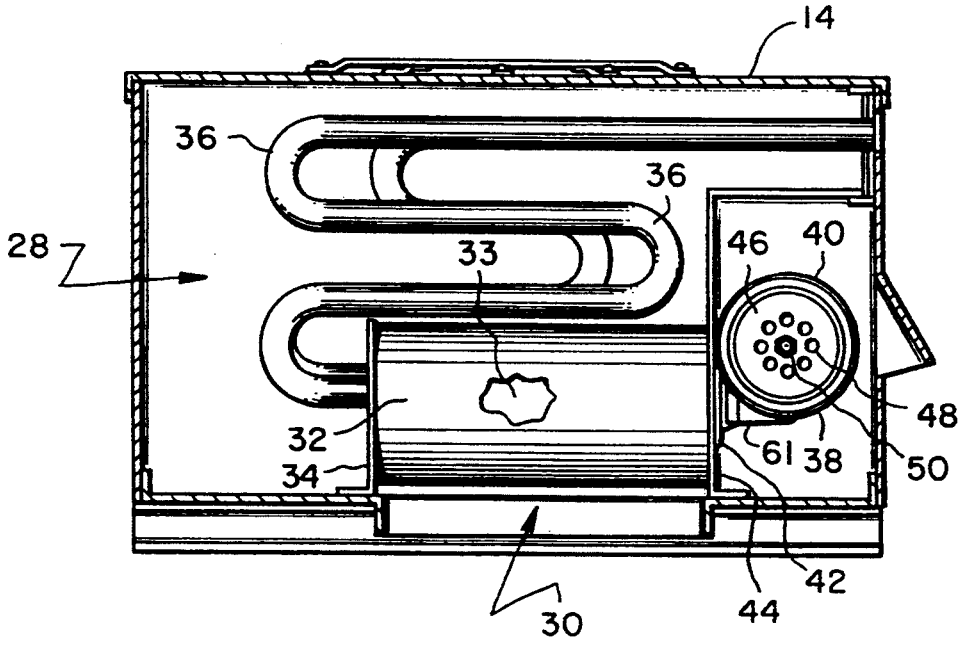
FIG. 2 is a sectional view taken along line 2—2 of FIG. 1, depicting the gas combustion furnace disposed within the heating and cooling unit.
Figure 3:
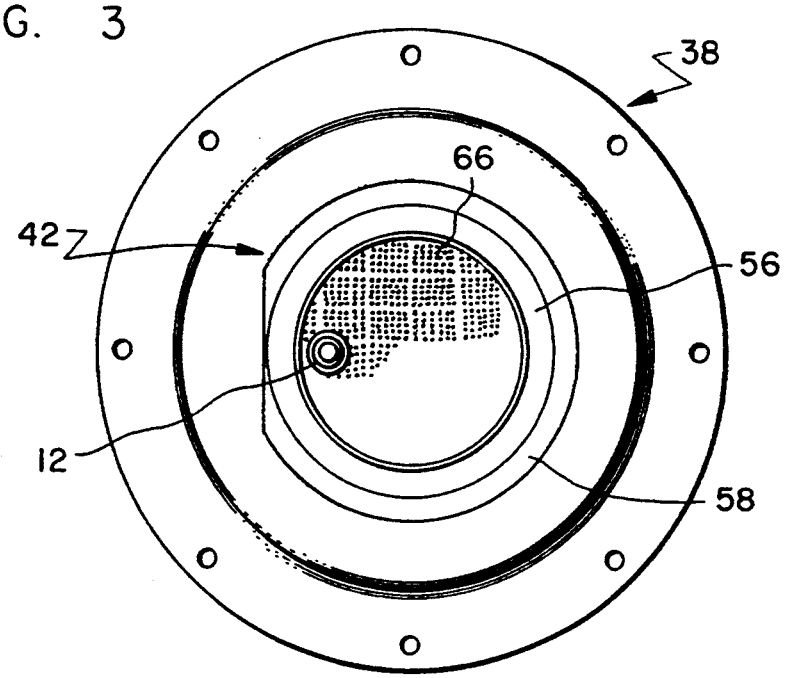
FIG. 3 is a front view of the burner plate assembly of the furnace burner ignitor assembly of the gas furnace depicted in FIG. 2, with an ignitor assembly in accordance with the present invention mounted thereon.
Figure 4:
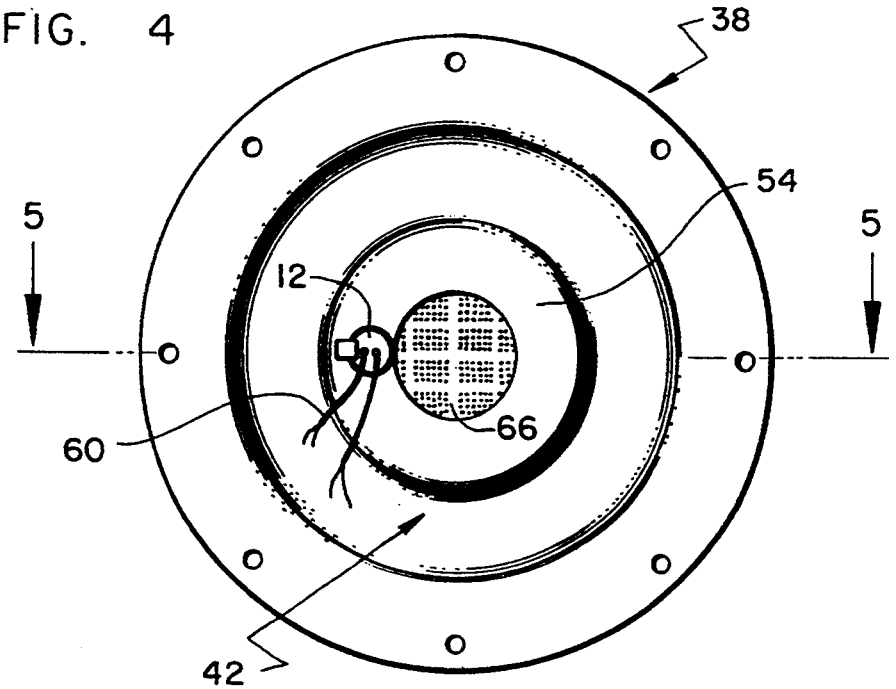
FIG. 4 is a rear view of the burner plate assembly and ignitor assembly depicted in FIG. 3.

The internal structure of the furnace heat exchanger section 28 is depicted in FIG. 2, showing a furnace assembly 30 within a housing 14. The furnace heat exchanger assembly 28 includes a drum 32 defining a combustion chamber 33, an end plate 34 sealingly secured to the distal end of the drum 32, a number of heat exchange tubes 36 secured to the end plate 34, and a burner assembly 38. The heat exchange tubes 36 are in fluid flow communication with the combustion plenum or chamber 33 of the drum 32 through apertures (not shown) in the end plate 34.

The burner assembly 38 broadly includes premixing chamber housing 40 and burner plate assembly 42. The furnace burner assembly 38 is sealingly secured to the proximate end 44 of the drum 32 for admitting a combustible gaseous mixture mixed by the premixing chamber housing 40 to the combustion plenum 33 defined by the drum 32 for ignition therein by the burner assembly 38. Preferably, the furnace burner assembly 38 is vertically disposed to prevent blockage by debris or foreign matter which may be present, although the furnace burner assembly 38 would work equally well if horizontally disposed for downward firing. An ignitor assembly 12 in accordance with the present invention is mounted on the burner plate assembly 42.

Referring again to FIG. 2, the premixing chamber housing 40 includes an inlet plate 46 having a plurality of air intake apertures 48 arranged about a centered combustible gas inlet 50. The inlet plate 46 is secured to the main portion of the premix chamber housing 40 by bolts (not shown), with a gasket sealingly interposed between the inlet plate 46 and the balance of the housing 40.

Figure 6:
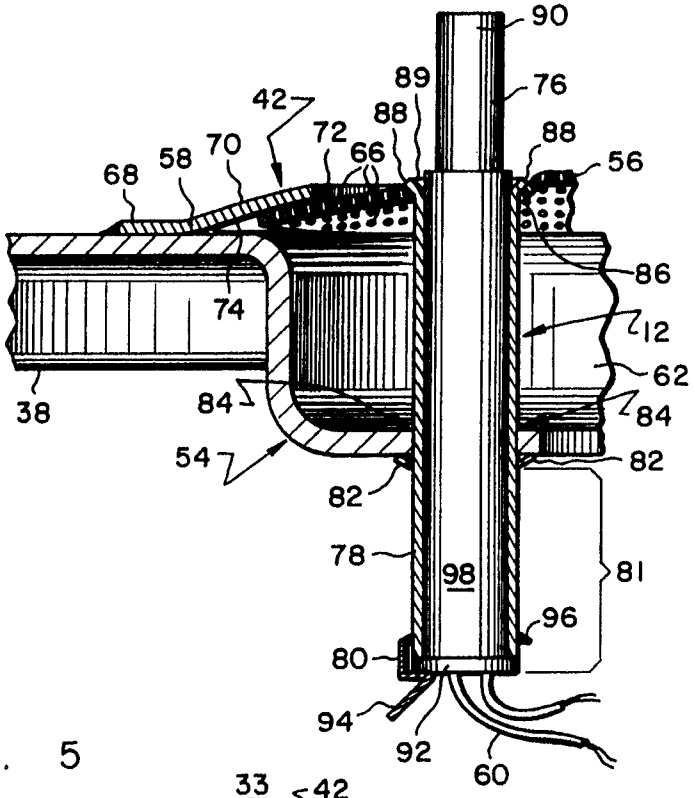
FIG. 6 is a fragmentary, enlarged view of the burner plate and ignitor assembly depicted in FIG. 5.
Figure 5:
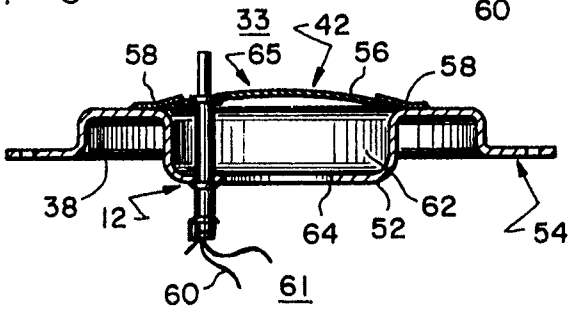
FIG. 5 is a sectional view taken along line 5—5 of FIG. 4.

Referring to FIGS. 3-6, the burner plate assembly 42 broadly includes a header 52 integrally carried by a mounting base 54, a burner plate 56, a retainer 58, and the ignitor assembly 12 including electrical lead-in wires 60. The premix chamber housing 40 is connected by a duct 61 to a plenum 62 formed by the header portion 52 of the mounting base 54 of the burner plate assembly 42. The mounting base 54 is part of the burner assembly 38, and is secured to the combustion drum 32 in a sealing manner at the proximate end 44 of the drum 32. Referring to FIGS. 5 and 6, a feed aperture 64 is centrally disposed within the header 52 of mounting base 54, thereby permitting a mixture of combustible gas and air mixture to pass in fluid flow communication from the duct 61 through the burner plate assembly 42 into the combustion chamber 33 of the drum 32.

Referring to FIGS. 5 and 6, the burner plate 56 is disposed across and about the feed aperture 64 in the mounting base 54. the burner plate 56 is perforated through with, for example, a plurality of 0.027 inch diameter apertures 66 in a line pattern spaced at 400 holes per square inch, with every sixth row and sixth column having no apertures therein and being a solid portion of the burner plate 56. Other arrangements of perforations are also contemplated. The burner plate 56 is generally circular and slightly concave with respect to the plenum 62 defined in the mounting base 54, with an outer convex surface 65 facing the combustion chamber 33 of the drum 32.

The burner plate 56 is retained on the mounting base 54 by a retainer ring 58 or other suitable fastening. The annular retainer ring 58 is of one piece design a flat outer ring 68 for securably mounting to the mounting base 54, and an inner concave portion 70 having an inner edge 72 defining an inner diameter cooperating with the burner plate 56 of the burner plate assembly 42. The inner portion 70 of the retaining ring 58 has an inner retaining surface 74 which engages a portion of burner plate 56, thereby securing the burner plate 56 to the burner plate assembly 42. The inner surface 74 simultaneously overlays and covers a selected number of apertures 66 in the burner plate 56 to prevent flow through the covered apertures 66. Cooperation of the burner plate 56 and the retainer ring 58 is achieved by providing a fit between the burner plate 56 and the inner concave portion 70 permitting longitudinal sliding engagement of the burner plate 56 with respect to the retainer 58.

The ignitor assembly 12 includes an ignitor element 76, a retaining sleeve 78, an ignitor clip 80, and a sleeve retainer 82. The ignition assembly 12 is offset from the center of the burner plate assembly 42, passes through mounting apertures 84, 86 respectively in the mounting base 54 and the burner plate 56, and preferably is a straight shanked ignition assembly.

The retaining sleeve 78 is used as a mounting apparatus for the ignitor assembly 12. The retaining sleeve 78 is generally tubular in shape, circular in cross-section, and is hollow. However, other cross-sections capable of maintaining the ignitor element 76 in place are contemplated including oval, triangular and hexagonal. The retaining sleeve 78 extends through the mounting aperture 84 in the mounting base 54 and extends through the mounting hole 86 in the burner plate 56 so that the retaining sleeve 78 is substantially transverse to the burner plate assembly 42. A flare 88 on or near the end 89 of the retaining sleeve 78 closest the drum 32 securely positions the retaining sleeve 78 within the burner plate assembly 42. The flare 88 of retaining sleeve 78 extends beyond burner plate 56 and is positioned adjacent to and in contact with burner plate 56. The retaining sleeve 78 may extend beyond mounting base 54 by varying dimensions, depending on the type of furnace in which it is being utilized and the placement of the flare 88 in relation to the end 89 of the retaining sleeve 78. The retaining sleeve 78 is preferably made of a durable material capable of withstanding prolonged exposure to intense heat, such as stainless steel.

The sleeve retainer 82 is forcibly positioned adjacent to and extends between the retaining sleeve 78 and the mounting base 54. The sleeve retainer 82 is preferably frustoconical in shape and is carried by retaining sleeve 78 in a friction fit. Once in place, the sleeve retainer 82 is designed to resist removal. The sleeve retainers 82 are preferably made of a heat resistant durable material, such as stainless steel. Although the sleeve retainer 82 and the ignitor clip 80 can be separate elements, in the preferred embodiment an extension portion 81 joins the ignitor clip 80 and the sleeve retainer 82 into a unit. The length of the extension portion 81 can be used to position the retaining sleeve 78.

The ignitor element 76 is designed to fit securely within the retaining sleeve 78 in such a manner that the ignitor element 76 is positioned substantially perpendicular to burner plate assembly 42. The ignitor element 76 includes an ignitor tip 90 at one end and a radially extending flange 92 at the opposed end. When positioned in the retaining sleeve 78, the flange 92 of the ignitor element 76 abuts an end 98 of the retaining sleeve 78. The ignitor tip 90 extends through and is positioned by the retaining sleeve 78, and extends beyond the burner plate 56 into the combustion plenum 33 of drum 32. Lead-in wires 60 are attached to the ignitor clip 80 which is in turn in contact with the ignitor element 76 on the non-combustion side of the burner plate assembly 42. Several ignition sources may be used for a straight ignitor entry, including 24 volt or 115 volt hot surface ignitors, or direct spark ignition sources. The ignitor element 76 is positioned by the ignitor clip 80, and may be easily inserted and removed from the retaining sleeve 78 as required for replacement.

The ignitor clip 80 includes a detent 94 and a ring clip 96. The ring clip 96 grips and is shiftably positioned around a portion of the diameter of the end 98 of the retaining sleeve 78. The ring clip 96 may optionally surround the entire diameter of the retaining sleeve 78. The detent 94 detachably latches and locks into position over and beneath the flange 92 of the ignitor element 76. The ignitor clip 80 is preferably made of a durable material such as spring steel.

Upon assembly, the retaining sleeve 78 is inserted first through the aperture 86 in the burner plate 56 and then through the aperture 84 in the mounting base 54 until the flared end 88 of retaining sleeve 78 engages the surface of the burner plate 56. The sleeve retainer 82 and ignitor clip 80 are slideably forced along the retaining sleeve 78 until the sleeve retainer 82 is securely positioned against the mounting base 54. The ignitor clip 80 is positioned around the retaining sleeve 78 so that the detent 94 can snapably engage the ignitor element 76. The ignitor element 76 is then inserted into the retaining sleeve 78 until the flange 92 rests adjacent the end 98 of the retaining sleeve 78, and is held in place by the snapable engagement of the flange 92 by the detent 94 of the ignitor clip 80. It will be appreciated that the ignitor element 76 can be easily replaced by manually shifting the detent 94 to the side, pulling out the ignitor element 76, and sliding a new ignitor element 76 into the retaining sleeve 76.

The ignitor assembly of this invention is advantageous in several ways. Most importantly, the lead-in wires 60 and the ignitor clip 80 are located in the duct 61, rather than in the hot and corrosive atmosphere of the combustion chamber 33. Also, the burner design is compact. Since ignitor element 76 is positioned within burner plate assembly 42, no additional external space surrounding and adjacent to the burner plate assembly 42 is required for the placement of the ignitor element 76. The compact ignitor assembly design is also advantageous in that the ignitor/retaining sleeve combination and ignitor clip work for different sizes of furnaces. The positioning of the ignitor element through the burner plate ensures reliable ignition since the source of ignition is at the optimum location in the burner without impacting burner reliability. In addition, low junction temperatures at the ignitor lead-in wires are obtained since the lead-in wires are positioned on the non-combustible side of the burner plate. The ignitor junction points are cooled by the premixed combustion gases, resulting in junction temperatures of only 500–600x F. The cooler operating temperatures at the lead-in wire junction contributes in a significant manner to the life expectancy of the ignitors.

The ignitor assembly design is extremely advantageous in that no tools are required to change the ignitor in the field. The ignitor element can be simply manually removed without having to disassemble the burner plate from the furnace. The ease of ignitor installation and removal contributes to reduced ignitor breakage and failure. Also, the sleeve retainer 78 and ignitor clip 80 act to properly and accurately position the ignitor element 76 without measurement.

We claim:

1. An ignitor assembly for a gas combusting power furnace having a combustion chamber and a burner plate assembly adjacent said combustion chamber for introducing a mixture of fuel and air into the combustion chamber, the burner plate assembly including a burner plate having a first surface facing the combustion chamber and an opposed, second surface facing away from the combustion chamber and structure defining an aperture extending between the first and second burner plate surfaces, comprising:

a generally elongated ignitor element;

a sleeve fixedly received within said aperture for slideably, removably receiving the ignitor element, the sleeve having a first end extending generally beyond the first surface of the burner plate and into said combustion chamber and an opposed second end extending beyond the second surface of the burner plate, said sleeve comprising a generally elongated ignitor element supporting tube for slideably receiving said ignitor element therein;

an ignitor element retainer operably coupled to said sleeve and selectively, removably retaining the ignitor element within the sleeve; and said burner plate assembly including a burner plate mounting base for mounting said burner plate in communication with said combustion chamber, said mounting base including structure spaced apart from said burner plate defining an ignitor element supporting tube receiving aperture, said ignitor element supporting tube being operably carried by said burner plate and said burner plate mounting base through said apertures oriented generally transverse to said burner plate first surface.

2. The invention as claimed in claim 1, including a retainer axially positioning said ignitor element supporting tube relative to said burner plate.

3. The invention as claimed in claim 2, said tube retainer including structure presenting a flange at a first end of said ignitor element supporting tube for operably engaging said burner plate first surface.

4. The invention as claimed in claim 3, said tube retainer including a retainer element forcibly, slideably carried by said tube for abuttably engaging said tube and said burner plate mounting base in a force fit.

5. The invention as claimed in claim 1, said ignitor element including a rearmost, radially extending flange, said ignitor element retainer including structure presenting a rearmost shoulder on said ignitor element supporting tube for operably abuttably engaging said ignitor element flange for axially positioning said ignitor element within said tube, and a clip snapably retaining said flange in operable engagement with said shoulder.

6. A premix furnace burner comprised of:

a housing having defining a premix chamber, the housing having a plurality of apertures therethrough, the apertures defining air intake for admitting air into the chamber and a gas inlet for admitting combustion gas into the chamber;

a blower impeller disposed rotatably within the housing for mixing the air and the combustible gas into a combustible mixture;

a burner plate disposed on the housing, the burner plate having a plurality of burner plate apertures for the passage of the combustible mixture therethrough, the burner plate apertures being substantially small relative to the burner plate, the burner plate including a first side, a second side and an ignitor aperture therethrough; and an ignitor assembly disposed in the ignitor aperture, the ignitor assembly including an ignitor located on the second side of the burner plate and an ignitor clip disposed on the first side of the burner plate.

7. The premix furnace burner of claim 6 wherein the ignitor assembly includes a peripheral sleeve portion adapted to retain the ignitor tip, the sleeve portion including means to engage the second side of the burner plate.

8. The premix furnace burner of claim 7 wherein the ignitor clip includes means for releasably engaging the sleeve portion and includes means for initiating operation the ignitor tip.

* * * * *